US010260519B2

(12) United States Patent
Fujimake et al.

(10) Patent No.: US 10,260,519 B2
(45) Date of Patent: Apr. 16, 2019

(54) BIDIRECTIONAL AXIAL FAN DEVICE

(71) Applicant: SANYO DENKI CO., LTD., Tokyo (JP)

(72) Inventors: Satoshi Fujimake, Tokyo (JP); Toshiya Nishizawa, Tokyo (JP); Takashi Kawashima, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 401 days.

(21) Appl. No.: 15/130,353

(22) Filed: Apr. 15, 2016

(65) Prior Publication Data

US 2016/0312792 A1 Oct. 27, 2016

(30) Foreign Application Priority Data

Apr. 24, 2015 (JP) ..... 2015-089226

(51) Int. Cl.
*F04D 29/32* (2006.01)
*F04D 29/52* (2006.01)
(Continued)

(52) U.S. Cl.
CPC ..... *F04D 29/325* (2013.01); *F04D 19/005* (2013.01); *F04D 25/0613* (2013.01); *F04D 25/08* (2013.01); *F04D 29/023* (2013.01); *F04D 29/526* (2013.01); *F04D 29/667* (2013.01); *F05D 2250/292* (2013.01)

(58) Field of Classification Search
CPC .. F04D 29/325; F04D 29/526; F04D 25/0613; F04D 19/005
See application file for complete search history.

(56) References Cited

U.S. PATENT DOCUMENTS 4,130,770 A * 12/1978 Wrobel ..... H02K 1/30 310/62
4,734,015 A * 3/1988 Wrobel ..... F04D 19/002 415/207
(Continued)

FOREIGN PATENT DOCUMENTS

CN 1704613 A 12/2005
JP 2013-113128 6/2013

OTHER PUBLICATIONS

Extended European Search Report dated Sep. 7, 2016 for the corresponding European Patent Application No. 16165162.5.

*Primary Examiner* — Jason D Shanske
*Assistant Examiner* — Brian O Peters
(74) *Attorney, Agent, or Firm* — Rankin, Hill & Clark LLP

(57) ABSTRACT

A bidirectional axial fan device includes: a moving blade member with a plurality of vanes; and a casing that includes a mounting portion, a frame, and a plurality of spokes, a motor being mounted to the mounting portion, the frame forming a ventilation hole. The plurality of spokes couple the mounting portion to the frame at an exhaust air side during a normal rotation of the motor. An inner peripheral surface of the frame has a multiple stage shape, in which a part on the exhaust air side during the normal rotation has a diameter larger than a diameter of a part on an air intake side during the normal rotation, such that intervals between tops on the exhaust air side during the normal rotation at outer peripheral edges of the plurality of vanes and the inner peripheral surface of the frame are expanded.

5 Claims, 5 Drawing Sheets

(51) Int. Cl.

| | |
|---|---|
| ***F04D 25/08*** | (2006.01) |
| ***F04D 29/02*** | (2006.01) |
| ***F04D 19/00*** | (2006.01) |
| ***F04D 25/06*** | (2006.01) |
| ***F04D 29/66*** | (2006.01) |

(56) References Cited

U.S. PATENT DOCUMENTS

| | | | | |
|---|---|---|---|---|
| 6,572,333 | B2 * | 6/2003 | Fujinaka | F04D 29/547 415/208.2 |
| 7,227,286 | B2 * | 6/2007 | Kudo | F04D 25/082 310/58 |
| 7,416,386 | B2 * | 8/2008 | Ho | F04D 25/0613 361/695 |
| 9,435,345 | B2 * | 9/2016 | Otsuka | F04D 29/384 |
| 2007/0122278 | A1 | 5/2007 | Lei | |
| 2011/0255957 | A1 | 10/2011 | Ogawara | |
| 2013/0136591 | A1 | 5/2013 | Yen | |
| 2013/0156561 | A1 | 6/2013 | Otsuka | |

* cited by examiner

| | MAXIMUM AIR VOLUME [$m^3$/min] | MAXIMUM STATIC PRESSURE [Pa] | ROTATION SPEED [$min^{-1}$] | SOUND PRESSURE LEVEL [dB(A)] | POWER CONSUMPTION [W] |
|---|---|---|---|---|---|
| EMBODIMENT | 2.05 | 105 | 3100 | 46 | 1.68 |
| COMPARATIVE EXAMPLE | 2.09 | 108 | 3100 | 49 | 1.72 |

BIDIRECTIONAL AXIAL FAN DEVICE

CROSS-REFERENCE TO RELATED APPLICATION

This application claims priority from Japanese Patent Application No. 2015-089226 filed with the Japan Patent Office on Apr. 24, 2015, the entire content of which is hereby incorporated by reference.

BACKGROUND

1. Technical Field

The present disclosure relates to a bidirectional axial fan device.

2. Description of the Related Art

JP-A-2013-113128 discloses the axial fan device. In this axial fan device, the motor is supported with the plurality of spokes and is disposed inside the venturi casing. A rotation of the impeller mounted to the motor ensures generating a flow of air in one direction in the venturi casing.

SUMMARY

A bidirectional axial fan device includes: a motor rotatable in normal and reverse directions; a moving blade member with a plurality of vanes, the moving blade member being rotatably driven by the motor; and a casing that includes a mounting portion, a frame, and a plurality of spokes, the motor being mounted to the mounting portion, the frame forming a ventilation hole, the plurality of spokes coupling the mounting portion to the frame, the plurality of vanes rotating in the ventilation hole. The plurality of spokes couples the mounting portion to the frame at an exhaust air side during a normal rotation of the motor. An inner peripheral surface of the frame has a multiple stage shape, in which a part on the exhaust air side during the normal rotation has a diameter larger than a diameter of a part on an air intake side during the normal rotation, such that intervals between tops on the exhaust air side during the normal rotation at outer peripheral edges of the plurality of vanes and the inner peripheral surface of the frame are expanded.

DESCRIPTION OF THE EMBODIMENTS

Figure 1:
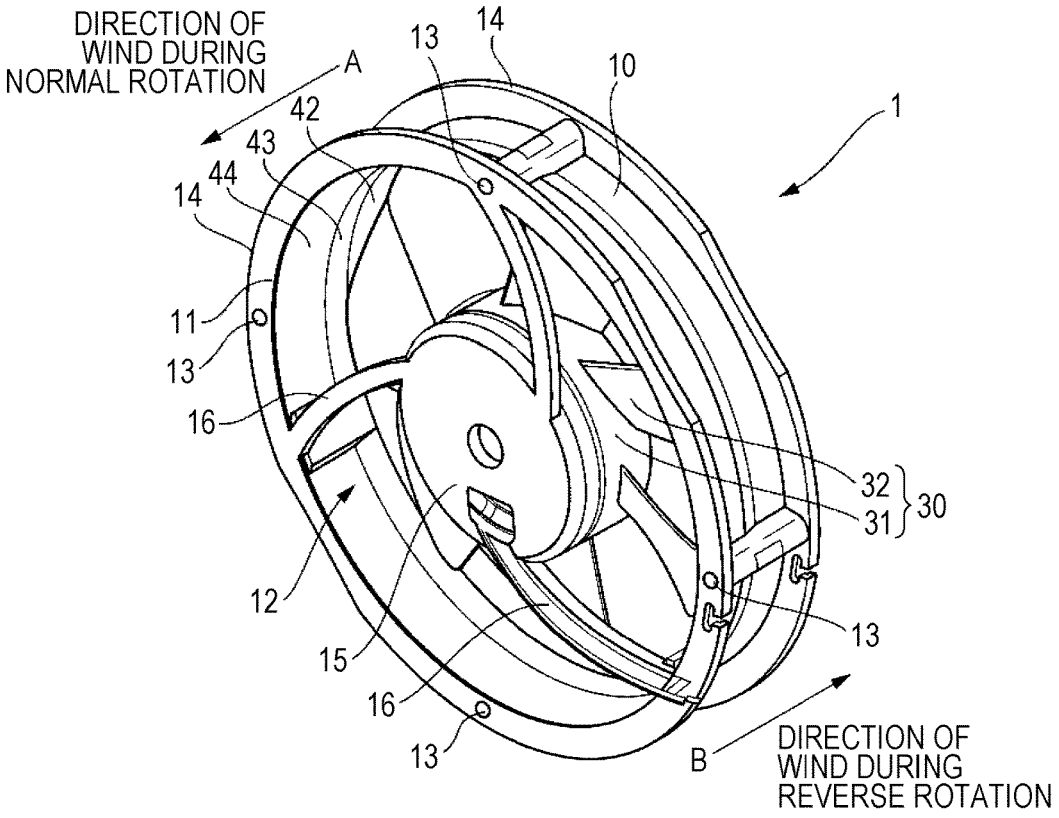
FIG. 1 is a perspective view of a bidirectional axial fan device of an embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

It is thought that an axial fan device employs a motor rotatable in normal and reverse directions to bidirectionally rotate a moving blade member mounted to the motor. A reverse rotation of the motor also reversely rotates the moving blade member. This ensures generating airflow in a direction opposite from the normal rotation.

However, with the bidirectional axial fan device configured by simply changing the motor, which rotatably drives the moving blade member, from one rotatable in one direction to one rotatable in normal and reverse directions, the ventilation property during the reverse rotation is less likely to be satisfactory like during the normal rotation.

For example, to dispose the motor inside the venturi casing, the bidirectional axial fan device uses the plurality of spokes. The plurality of spokes is disposed on an exhaust air side during the normal rotation of the motor of the moving blade member so as not to degrade the ventilation property during the normal rotation. When the moving blade member is reversely rotated inside the venturi casing, the moving blade member suctions air from between the plurality of spokes. That is, the moving blade member suctions airflow disturbed around the plurality of spokes. This results in, for example, an increase in air-blowing sound during the reverse rotation.

Thus, the bidirectional axial fan device is requested to improve the ventilation property during the reverse rotation.

A bidirectional axial fan device according to an aspect of the present disclosure (the present bidirectional axial fan device) includes: a motor rotatable in normal and reverse directions; a moving blade member with a plurality of vanes, the moving blade member being rotatably driven by the motor; and a casing that includes a mounting portion, a frame, and a plurality of spokes, the motor being mounted to the mounting portion, the frame forming a ventilation hole, the plurality of spokes coupling the mounting portion to the frame, the plurality of vanes rotating in the ventilation hole. The plurality of spokes couples the mounting portion to the frame at an exhaust air side during a normal rotation of the motor. An inner peripheral surface of the frame has a multiple stage shape, in which a part on the exhaust air side during the normal rotation has a diameter larger than a diameter of a part on an air intake side during the normal rotation, such that intervals between tops on the exhaust air side during the normal rotation at outer peripheral edges of the plurality of vanes and the inner peripheral surface of the frame are expanded.

In the present bidirectional axial fan device, the inner peripheral surface of the frame of the casing is formed into the multiple stage shape where the part on the exhaust air side during the normal rotation has the diameter larger than the part on the air intake side during the normal rotation. This expands the interval between the tops on the exhaust air side during the normal rotation at the outer peripheral edges of the plurality of vanes and the inner peripheral surface of the frame.

Accordingly, for example, compared with the case where the inner peripheral surface of the frame is flat and therefore does not have the multiple stage shape, the bidirectional axial fan device expands the interval between these tops of the plurality of vanes and the inner peripheral surface of the frame. This ensures restraining a pressure variation of air near the top on the air intake side at the outer peripheral edge of the vane during the reverse rotation. Consequently, the air-blowing sound during the reverse rotation can be restrained.

Moreover, in the present bidirectional axial fan device, the inner peripheral surface of the frame is formed into the multiple stage shape. Accordingly, at the inner peripheral surface of the frame, the part on the exhaust air side during the normal rotation has the diameter larger than the part on the air intake side during the normal rotation. Accordingly, the present bidirectional axial fan device restrains the reduction in the static pressure during the normal rotation like the case where, for example, the inner peripheral surface of the frame is configured to entirely have the large diameter.

In the present bidirectional axial fan device, the part on the exhaust air side during the normal rotation (namely, the air intake side during the reverse rotation) at the inner peripheral surface of the frame has the large diameter. In view of this, although the plurality of spokes is disposed on the air intake side during the reverse rotation, the static pressure during the reverse rotation can be improved. That is, the static pressure characteristic during the reverse rotation can be close to the static pressure characteristic during the normal rotation.

Thus, the present bidirectional axial fan device ensures improving the static pressure characteristic during the reverse rotation so as to be close to the static pressure characteristic during the normal rotation. Furthermore, while restraining a large influence to these static pressure characteristic during the normal rotation and static pressure characteristic during the reverse rotation, the bidirectional axial fan device ensures improving the air-blowing sound during the reverse rotation.

The following describes an embodiment of the present disclosure with reference to the drawings.

Figure 2:
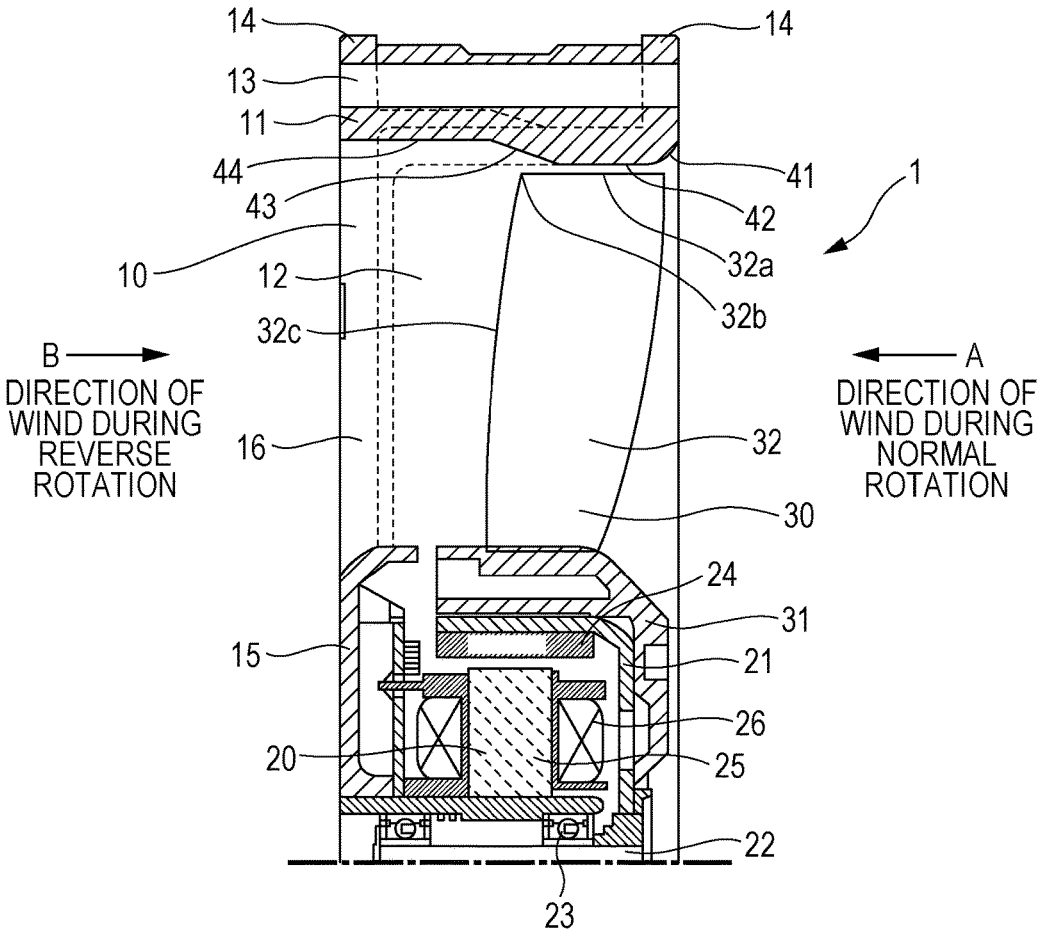
FIG. 2 is an explanatory view illustrating a partial cross section of the bidirectional axial fan device illustrated in FIG. 1.

FIG. 1 is a perspective view of a bidirectional axial fan device 1 according to the embodiment of the present disclosure. FIG. 2 is an explanatory view illustrating a partial cross section of the bidirectional axial fan device 1 illustrated in FIG. 1. FIG. 2 illustrates a cross section of the upper half portion of the bidirectional axial fan device 1.

In the bidirectional axial fan device 1 illustrated in FIGS. 1 and 2, a motor 20 rotatably drives a moving blade member 30 in normal and reverse directions inside a ventilation hole 12 of a venturi casing 10. Accordingly, the bidirectional axial fan device 1 can send air from one side to the other side of the ventilation hole 12 and send air from the other side to the one side of the ventilation hole 12. Thus, the one side of the ventilation hole 12 of the venturi casing 10 serves as an air intake side during the normal rotation and serves as an exhaust air side during the reverse rotation. The other side of the ventilation hole 12 of the venturi casing 10 serves as the exhaust air side during the normal rotation and serves as the air intake side during the reverse rotation.

The venturi casing 10 is, for example made of synthetic resin. The venturi casing 10 includes a frame 11, which surrounds an outer periphery of the rotating moving blade member 30, the ventilation hole 12 formed by the frame 11, a mounting portion 15 of the motor 20, and a plurality of spokes 16, which couple the frame 11 to the mounting portion 15.

The frame 11 is formed into an approximately tubular shape or approximately annular shape. Forming the frame 11 into the approximately annular shape forms the ventilation hole 12 that concentrically passes through the frame 11. A plurality of fixing holes 13 is formed on the approximately annular-shaped frame 11. A pair of flanges 14 are disposed upright on the outer periphery of the frame 11.

The fixing holes 13 pass through the approximately annular-shaped frame 11 from a surface on one side to a surface on the other side. For example, an insertion of screws into the fixing holes 13 ensures mounting the venturi casing 10 to, for example, another casing.

The mounting portion 15 is formed into, for example, a circular plate shape. The mounting portion 15 may be formed into a size, for example, identical to the outer periphery of the motor 20. The spokes 16 are formed into a thin rod shape such that a flow of air inside the ventilation hole 12 is less likely to be obstructed. The spokes 16 of this embodiment are formed into a curved shape. The plurality of spokes 16 couples the mounting portion 15 to the frame 11 on the other side, which is the exhaust air side during the normal rotation. The mounting portion 15 is disposed at the center of the ventilation hole 12 concentrically with the ventilation hole 12.

The motor 20 is rotatable in the normal and reverse directions. The motor 20 is an outer rotor type and includes a rotor yoke 21, a rotation shaft 22, a rotor magnet 24, a stator core 25, and a stator coil 26. The rotor yoke 21 has an approximately cup shape. The rotation shaft 22 is disposed upright on the center inside of the approximately cup-shaped rotor yoke 21. The rotation shaft 22 is rotatably mounted to the mounting portion 15 via a bearing member 23.

In a space surrounded by the approximately cup-shaped rotor yoke 21 and the mounting portion 15, the rotor magnet 24 and the stator core 25 are disposed spaced from one another. The rotor magnet 24 is disposed at the inner peripheral surface of the approximately cup-shaped rotor yoke 21. The stator core 25 is mounted to the mounting portion 15. The stator coil 26 is wound around the stator core 25. By energizing the stator coil 26, a magnetic field generated in the stator core 25 and a magnetic field in the rotor magnet 24 repel and attract one another. This rotates the rotor magnet 24, the rotor yoke 21, and the rotation shaft 22. Switching a direction of a current flowing through the stator coil 26 reverses the rotation direction of the motor 20. This rotates the motor 20 in the normal and reverse directions.

The moving blade member 30 is, for example, made of synthetic resin. The moving blade member 30 includes an approximately cup-shaped cup 31 to which the rotor yoke 21 is engaged and a plurality of vanes 32. The plurality of vanes 32 is arrayed projecting outward from the outer peripheral surface of the approximately cup-shaped cup 31. The vanes 32 are each inclined with respect to the rotation direction. Accordingly, the rotation of the moving blade member 30 ensures generating airflow. Reserving the rotation direction also reserves the direction of the airflow.

With the bidirectional axial fan device 1, rotatably driving the moving blade member 30 by the motor 20 ensures generating bidirectional airflow. For example, the normal rotation of the motor 20 ensures generating airflow from one side to the other side in the ventilation hole 12 of the venturi casing 10 (See an arrow A in FIGS. 1 and 2. This arrow A indicates a direction of wind during the normal rotation). In this case, no obstacle of intake air such as the plurality of spokes 16 is present on the air intake side of the rotating moving blade member 30. In view of this, the airflow of little disturbance is generated, and this airflow can be exhausted to the other side of the ventilation hole 12 of the venturi casing 10.

In contrast to this, when the motor 20 rotates reversely, the members obstructing the intake air, the plurality of spokes 16, are present on the air intake side of the rotating moving blade member 30. Therefore, if no countermeasure is taken, airflow disturbed by the plurality of spokes 16 is suctioned. This disturbed airflow is exhausted to the one side of the ventilation hole 12 of the venturi casing 10 (See an arrow B in FIGS. 1 and 2. This arrow B indicates the direction of wind during the reverse rotation). This results in an increase in an air-blowing sound during the reverse rotation, also degrading a static pressure characteristic during the reverse rotation.

In view of this, the bidirectional axial fan device 1 that ensures the rotation in the normal and reverse directions according to the embodiment is configured to improve the ventilation properties such as the static pressure characteristic and the air-blowing sound during the reverse rotation. The following describes this embodiment in detail.

As illustrated in FIG. 2, the inner peripheral surface of the frame 11 of the venturi casing 10 has a tapered opening portion 41, a small diameter portion 42, an intermediate tapered portion 43, and a large diameter portion 44 in the order from the air intake side during the normal rotation, which is the one side. The inner peripheral surface of the frame 11 of the venturi casing 10 is an inner peripheral surface (the inner peripheral surface formed with the ventilation hole 12) corresponding to the ventilation hole 12 on the frame 11 of the venturi casing 10.

The small diameter portion 42 has an annular-shaped inner peripheral surface. The inner peripheral surface of the small diameter portion 42 forms a linear shape on the cross section. The linear-shaped inner peripheral surface of the small diameter portion 42 is opposed to a linear-shaped outer edge side of the vane 32 of the moving blade member 30 so as to be approximately parallel to the outer edge side with a clearance provided.

The large diameter portion 44 has an annular-shaped inner peripheral surface having a diameter larger than the small diameter portion 42. The inner peripheral surface of the large diameter portion 44 forms a linear shape on the cross section. The linear-shaped inner peripheral surface of the large diameter portion 44 is opposed to a linear-shaped outer edge side of the vane 32 of the moving blade member 30 so as to be approximately parallel to the outer edge side with a clearance provided. The clearance between the large diameter portion 44 and the outer edge side of the vane 32 is wider than the clearance between the small diameter portion 42 and the outer edge side of the vane 32. The small diameter portion 42 and the large diameter portion 44 are concentrically formed. This forms the inner peripheral surface of the frame 11 into the multiple stage shape, two stages.

The intermediate tapered portion 43 has an inner peripheral surface. The inner peripheral surface of the intermediate tapered portion 43 is linearly inclined such that the radius decreases from the large diameter portion 44 side to the small diameter portion 42 side. With the inner peripheral surface of the intermediate tapered portion 43, the inner peripheral surface of the small diameter portion 42 and the inner peripheral surface of the large diameter portion 44 are formed into a continuous surface. By thus disposing the intermediate tapered portion 43 between the small diameter portion 42 and the large diameter portion 44, a wall surface, which stands vertically to an extending direction of the rotation shaft 22, and a part at which an inner diameter rapidly changes, are not formed on the inner peripheral surface of the ventilation hole 12. For example, these members are formed when the small diameter portion 42 and the large diameter portion 44 are directly coupled.

The tapered opening portion 41 has the inner peripheral surface. The inner peripheral surface of the tapered opening portion 41 is inclined forming a curved line such that the radius increases from the small diameter portion 42 to the one side of the frame 11 of the venturi casing 10. The arc-shaped inner peripheral surface of the tapered opening portion 41 and the inner peripheral surface of the small diameter portion 42 form a continuous surface. An opening formed on the one side of the frame 11 by the tapered opening portion 41 and an opening formed on the other side of the frame 11 by the large diameter portion 44 can be matched to have an approximately identical size.

As illustrated in FIG. 2, the inner peripheral surface of the frame 11 is formed into the multiple stage shape where the part on the other side, which is the exhaust air side during the normal rotation (for example, the part including the inner peripheral surface of the large diameter portion 44), has a diameter larger than the part on the one side, which is the air intake side during the normal rotation (for example, the part including the inner peripheral surface of the small diameter portion 42). The intermediate tapered portion 43 is positioned outside (for example, radially outside) a top 32*b* on the exhaust air side during the normal rotation at an outer peripheral edge 32*a* of the vane 32. This widens the interval between the top 32*b* on the exhaust air side during the normal rotation at the outer peripheral edge 32*a* of the vane 32 and the inner peripheral surface of the frame 11.

At an edge 32*c* on the other side of the vane 32, the top 32*b*, which is an outer periphery end of the edge 32*c*, is curved so as to approach the one side. Accordingly, the edge 32*c*, which is on the exhaust air side during the normal rotation, at the vane 32 curves such that the outside (the top side) of this moving blade member 30 approaches the air intake side during the normal rotation with respect to the center side of the moving blade member 30 (the rotating moving blade member 30). Consequently, as illustrated in FIG. 2, an extended line of this edge 32*c* intersects with the inclined inner peripheral surface of the intermediate tapered portion 43 at an approximately vertical angle. Accordingly, the airflow near the outer peripheral edge 32*a* of the vane 32 becomes airflow inclined with respect to the rotation shaft 22.

The use of the shape of the inner peripheral surface of the frame 11 of the venturi casing 10 and the shape of the vane 32 draws in air from between the opening on the one side of the venturi casing 10 and a part near a minimum interval part Gmin by negative pressure during the normal rotation. The minimum interval part Gmin is a part on the most other side in the part where the interval between the inner peripheral surface of the frame 11 and the outer peripheral edge 32*a* of the vane 32 is minimized.

The air drawn in by the negative pressure is sent out from the part near this minimum interval part Gmin to the opening on the other side of the venturi casing 10. Therefore, the air suctioned from the opening on the one side free from the plurality of spokes 16 can be efficiently collected from the opening expanded by the tapered opening portion 41 by the negative pressure. This air smoothly passes through the inside of the inner peripheral surface of the small diameter portion 42 at the uniform size. Afterwards, this air passes through the minimum interval part Gmin, expands from the opening on the other side free from a large ventilation resistance in the inner peripheral surface whose size is expanded by the large diameter portion 44, and then is blown out. Consequently, the airflow during the normal rotation is sent at a high static pressure without largely disturbed by the plurality of spokes 16, which are disposed on the near side of the opening on the other side.

During the reverse rotation, the air is drawn in from between the opening on the other side of the venturi casing 10 and the part near the minimum interval part Gmin by negative pressure. The air drawn in by the negative pressure is sent out from the part near this minimum interval part Gmin to the opening on the one side of the venturi casing 10. Accordingly, in spite of the presence of the plurality of spokes 16, the air suctioned from the opening on the other side is efficiently collected without largely disturbed from the opening whose opening area is expanded by the large diameter portion 44 by the negative pressure. Afterwards, this air passes through the minimum interval part Gmin, smoothly passes through the inside of the inner peripheral surface of the small diameter portion 42 with the uniform size, and widely blows out from the opening expanded by the tapered opening portion 41. Consequently, although the plurality of spokes 16 is disposed on the air intake side, the airflow during the reverse rotation is sent at good static pressure without largely disturbed by the spokes 16.

Figure 3:
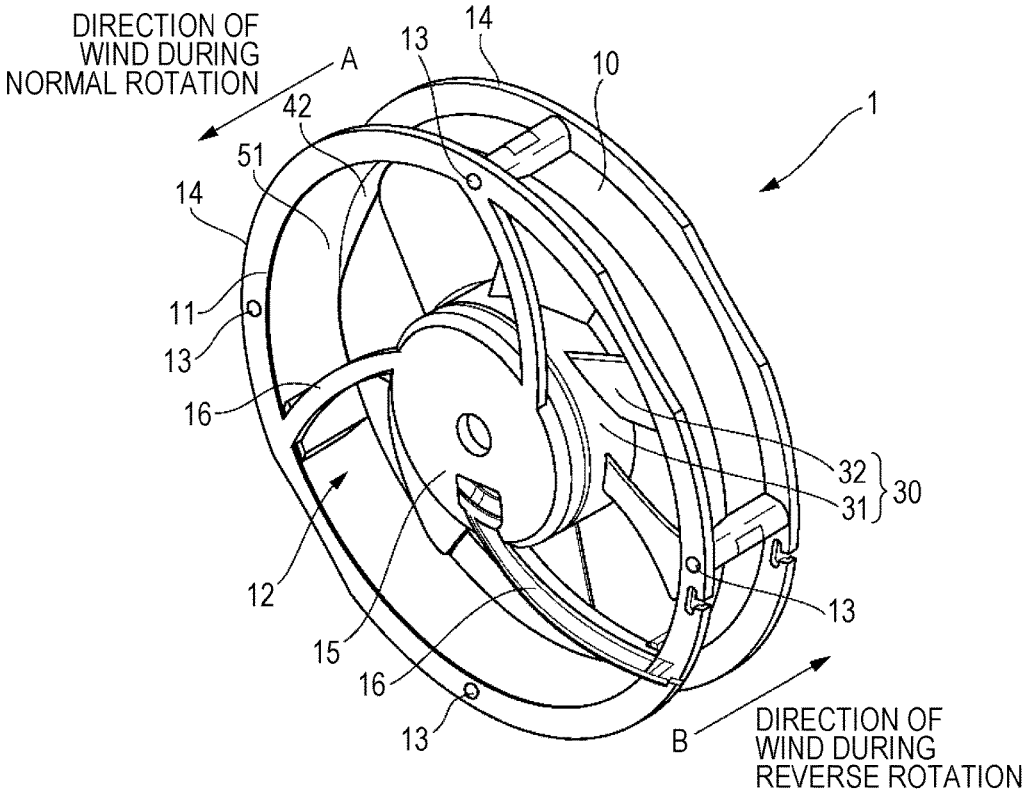
FIG. 3 is a perspective view of the bidirectional axial fan device of a comparative example.
Figure 4:
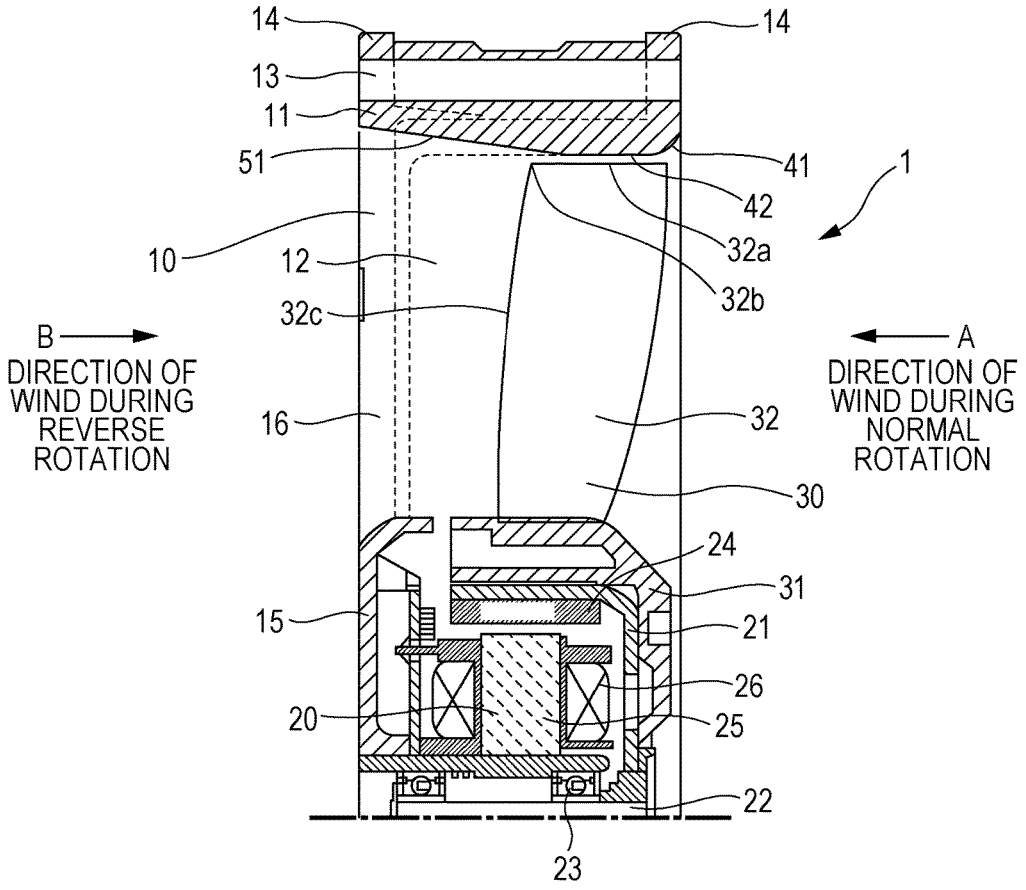
FIG. 4 is an explanatory view illustrating a partial cross section of the bidirectional axial fan device of the comparative example illustrated in FIG. 3.

Next, the ventilation property of the bidirectional axial fan device 1 of this embodiment is described compared with the comparative example. FIG. 3 is a perspective view of the bidirectional axial fan device 1 of the comparative example. FIG. 4 is an explanatory view illustrating a partial cross section of the bidirectional axial fan device 1 of the comparative example illustrated in FIG. 3. FIG. 4 illustrates a cross section of the upper half portion of the bidirectional axial fan device 1. In FIGS. 3 and 4, the arrow A indicates the direction of wind during the normal rotation, and the arrow B indicates the direction of wind during the reverse rotation.

The bidirectional axial fan device 1 of the comparative example illustrated in FIGS. 3 and 4 differs from the bidirectional axial fan device 1 of this embodiment in the shape of the inner peripheral surface of the frame 11 of the venturi casing 10. For easy comparison with this embodiment, like reference numerals designate corresponding parts in the comparative example with respect to the embodiment. However, even if the identical name and reference numeral are used, the members of the embodiment and the comparative example may have configurations different from one another.

Specifically, the inner peripheral surface of the frame 11 of the comparative example includes the tapered opening portion 41, the small diameter portion 42, and a large tapered portion 51 in the order from the air intake side during the normal rotation, which is the one side. The inner peripheral surface of the frame 11 does not have the multiple stage shape. The large tapered portion 51 has the inner peripheral surface. The inner peripheral surface of the large tapered portion 51 is linearly inclined such that the radius decreases from the opening on the other side to the small diameter portion 42 side. An inclination angle of the large tapered portion 51 is smaller than the inclination angle of the intermediate tapered portion 43 of this embodiment (see FIG. 2). The large tapered portion 51 is positioned outside the top 32*b* on the exhaust air side during the normal rotation at the outer peripheral edge 32*a* of the vane 32. Consequently, an interval between the top 32*b* on the exhaust air side during the normal rotation at the outer peripheral edge 32*a* of the vane 32 and the inner peripheral surface of the frame 11 is narrower than the interval of this embodiment.

At the edge 32*c* on the other side of the vane 32, the top 32*b*, which is the outer periphery end of the edge 32*c*, is curved so as to approach the one side. Consequently, the extended line of this edge 32*c* intersects with the inclined inner peripheral surface of the large tapered portion 51 at an approximately vertical angle.

Thus, with the bidirectional axial fan device 1 of the comparative example illustrated in FIGS. 3 and 4, the interval between the top 32*b* on the exhaust air side during the normal rotation at the outer peripheral edge 32*a* of the vane 32 and the inner peripheral surface of the frame 11 expands. Furthermore, the extended line of the edge 32*c* on the other side of the vane 32 intersects with the inner peripheral surface of the large tapered portion 51 so as to be an approximately vertical. Accordingly, the bidirectional axial fan device 1 of this comparative example also improves the ventilation property during the reverse rotation compared with the case where, for example, the inner peripheral surface of the frame 11 is formed only with the linear-shaped inner peripheral surface with a diameter identical to the diameter of the small diameter portion 42.

Figures 5, 6:
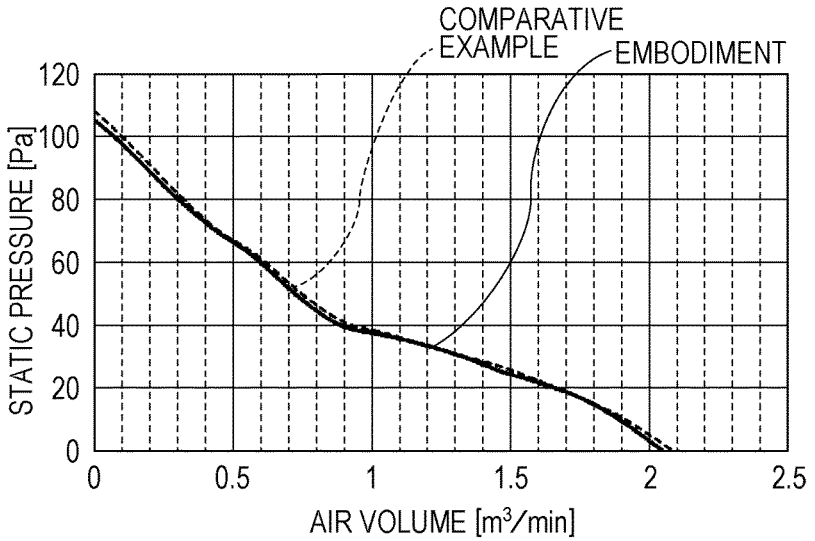
FIG. 5 is a comparative table of an example of a ventilation property during a reverse rotation of the embodiment and an example of a ventilation property during a reverse rotation of the comparative example.
FIG. 6 is a characteristic diagram illustrating an example of an air volume static pressure characteristic during the reverse rotation of the embodiment and an example of an air volume static pressure characteristic during the reverse rotation of the comparative example.

FIG. 5 is a comparative table of an example of the ventilation property during the reverse rotation of the embodiment and an example of the ventilation property during the reverse rotation of the comparative example. FIG. 5 illustrates the comparisons in a maximum air volume during the reverse rotation, a maximum static pressure during the reverse rotation, a rotation speed of the reverse rotation, a sound pressure level during the reverse rotation, and a power consumption during the reverse rotation. As illustrated in FIG. 5, the maximum air volume and the maximum static pressure during the reverse rotation of this embodiment have approximately identical values to those values of the comparative example. In the case of the identical rotation speed between this embodiment and the comparative example, the sound pressure level during the reverse rotation of this embodiment reduces by 3 dB compared with the comparative example. Moreover, the power consumption value during the reverse rotation at the identical rotation speed of this embodiment is approximately identical to the value of the comparative example.

FIG. 6 is a characteristic diagram illustrating an example of an air volume static pressure characteristic during the reverse rotation of the embodiment and an example of the air volume static pressure characteristic during the reverse rotation of the comparative example. The horizontal axis in FIG. 6 indicates the air volume during the reverse rotation, and the vertical axis in FIG. 6 indicates the static pressure during the reverse rotation. As illustrated in FIG. 6, the air volume static pressure characteristic during the reverse rotation of this embodiment is approximately identical to the air volume static pressure characteristic during the reverse rotation of the comparative example.

As described above, for example, compared with the case where the inner peripheral surface of the frame 11 is formed only with the linear-shaped inner peripheral surface with the diameter identical to the diameter of the small diameter portion 42, an improvement in the ventilation property during the reverse rotation can be expected to the comparative example. This embodiment ensures obtaining the ventilation property equivalent to such comparative example and ensures remarkably reducing the sound pressure level during the reverse rotation.

As described above, in this embodiment, the inner peripheral surface of the frame 11 is formed into the multiple stage shape where the part on the other (the other end) side, which is the exhaust air side during the normal rotation, has the diameter larger than the part on the one (one end) side, which is the air intake side during the normal rotation. This expands the interval between the tops 32*b* on the exhaust air side during the normal rotation at the outer peripheral edges 32*a* of the plurality of vanes 32 and the inner peripheral surface of the frame 11.

For example, compared with the case where the inner peripheral surface of the frame 11 has a uniform annular shape and therefore does not have the multiple stage shape, this embodiment expands the interval between these tops 32*b* of the plurality of vanes 32 and the inner peripheral surface of the frame 11. This ensures restraining a pressure variation of air near the top 32*b* at the outer peripheral edge 32*a* of the vane 32 during the reverse rotation. Additionally, compared with the case where the large tapered portion 51 is formed, this embodiment ensures restraining the pressure variation of air near the top 32*b* at the outer peripheral edge 32*a* of the vane 32 during the reverse rotation. Consequently, the air-blowing sound during the reverse rotation can be restrained.

Moreover, in this embodiment, the inner peripheral surface of the frame 11 is formed into the multiple stage shape. Accordingly, at the inner peripheral surface of the frame 11, the part on the exhaust air side during the normal rotation has the diameter larger than the part on the air intake side during the normal rotation. Accordingly, this embodiment restrains the reduction in the static pressure during the normal rotation like the case where, for example, the inner peripheral surface of the frame 11 is configured to entirely have the large diameter.

In this embodiment, the part on the exhaust air side during the normal rotation (namely, the air intake side during the reverse rotation) at the inner peripheral surface of the frame 11 has the large diameter. In view of this, although the plurality of spokes 16 is disposed on the air intake side during the reverse rotation, the static pressure during the reverse rotation can be improved. That is, the static pressure characteristic during the reverse rotation can be close to the static pressure characteristic during the normal rotation.

Thus, this embodiment ensures improving the static pressure characteristic during the reverse rotation so as to be close to the static pressure characteristic during the normal rotation. Furthermore, while restraining a large influence to these static pressure characteristic during the normal rotation and static pressure characteristic during the reverse rotation, this embodiment ensures improving the air-blowing sound during the reverse rotation.

This embodiment includes the intermediate tapered portion 43 between the small diameter portion 42 and the large diameter portion 44 at the inner peripheral surface of the frame 11. Therefore, a wall surface stood against the flow of air is not formed at the inner peripheral surface of the frame 11. This wall surface is, for example, formed in the case where the small diameter portion 42 and the large diameter portion 44 are directly continuous. With the wall surface stood against the flow of air, air strikes against this wall surface, a whirl occurs, and the air is likely to accumulate. In contrast to this, this embodiment is less likely to cause such situation. Consequently, this embodiment ensures further smoothing the flow of air, improving the static pressure characteristic during the reverse rotation, and further restraining the air-blowing sound during the reverse rotation.

In this embodiment, the edge 32*c* on the other side, which is the exhaust air side during the normal rotation, at each vane 32 curves such that the outside (the top side) of the moving blade member 30 approaches the air intake side during the normal rotation with respect to the center side of the rotating moving blade member 30. Accordingly, the flow of air drawn to the vane 32 near the outer peripheral edge 32*a* at the vane 32 is obliquely inclined with respect to the direction along the ventilation hole 12 and the rotation shaft 22. Consequently, this air flowing direction is the direction along the inner peripheral surface of the intermediate tapered portion 43.

Consequently, this embodiment ensures further smoothing the flow of air. This ensures further restraining the pressure variation near the outer peripheral edge 32*a* during the reverse rotation. This ensures further restraining the air-blowing sound during the reverse rotation.

In this embodiment, the inner peripheral surface of the ventilation hole 12 at the frame 11 includes the tapered opening portion 41. The tapered opening portion 41 expands the opening on the air intake side during the normal rotation at the frame 11 to the air intake side during the normal rotation. Accordingly, the size of the opening on the air intake side during the normal rotation, which is formed on the frame 11 by the ventilation hole 12, can be close to the size of the opening on the exhaust air side during the normal rotation, which is formed by the large diameter portion 44. Consequently, the following effect can be obtained.

For example, assume that the bidirectional axial fan device 1 is mounted to the device casing. In this case, the size of the vent hole formed on this device casing when the bidirectional axial fan device 1 is mounted to the device casing at the air intake side during the normal rotation of the frame 11 can be matched to be approximately identical to the size of the vent hole formed on this device casing when the bidirectional axial fan device 1 is mounted to the device casing at the exhaust air side during the normal rotation of the frame 11. This eliminates a need for changing the size of the vent hole at the device casing according to the side of the bidirectional axial fan device 1 mounted to the device casing.

The bidirectional axial fan device 1 rotatable in the normal and reverse directions having such good ventilation property, for example, can be used as a cooling fan in an electronic apparatus such as a personal computer and a power supply unit and also can be used as a ventilation fan in a clean room. This ensures obtaining high ventilation property and obtaining high silent property in both the normal and reverse directions.

The embodiment described above is an example of a preferable embodiment of this disclosure. However, the technique of the present disclosure is not limited to this. The above-described embodiment can be modified or changed in various ways without departing from the gist of the technique of the present disclosure.

For example, in the embodiment, the inner peripheral surface of the frame 11 is formed into the multiple stage shape, two stages, having the large diameter portion 44 and the small diameter portion 42. Besides, for example, the inner peripheral surface of the frame 11 may be formed into the multiple stage shape of equal to or more than three stages. In this case as well, the effect similar to the embodiment can be expected by forming the inner peripheral surface of the frame 11 into the multiple stage shape by which the exhaust air side during the normal rotation has the diameter larger than the air intake side during the normal rotation and by expanding the interval between the tops 32*b* on the exhaust air side during the normal rotation at the outer peripheral edges 32*a* of the plurality of vanes 32 and the inner peripheral surface of the frame 11.

The embodiment includes the intermediate tapered portion 43 between the large diameter portion 44 and the small diameter portion 42. Besides, for example, the large diameter portion 44 and the small diameter portion 42 may be directly coupled. In this case as well, the inner peripheral surface of the frame 11 is formed into the multiple stage shape. By the expansion of the interval between the tops 32*b* on the exhaust air side during the normal rotation at the outer peripheral edges 32*a* of the plurality of vanes 32 and the inner peripheral surface of the frame 11, an improvement in the ventilation property including the silent property during the reverse rotation can be expected.

With the embodiment, the edge 32*c* on the other side, which is on the exhaust air side during the normal rotation, at the vane 32 curves such that the outside (the top side) of the moving blade member 30 approaches the air intake side during the normal rotation with respect to the center side of the rotating moving blade member 30. Besides, for example, the edge 32*c* on the other side, which is on the exhaust air side during the normal rotation, at the vane 32 may be stood approximately vertical to the rotation shaft 22. In this case as well, the inner peripheral surface of the frame 11 is formed into the multiple stage shape such that the part on the exhaust air side during the normal rotation has the diameter larger than the part on the air intake side during the normal rotation. Additionally, by expanding the interval between the tops 32*b* on the exhaust air side during the normal rotation at the outer peripheral edges 32*a* of the plurality of vanes 32 and the inner peripheral surface of the frame 11 by the large diameter portion 44, the improvement in the ventilation property including the silent property during the reverse rotation can be expected.

The embodiment includes the tapered opening portion 41 at the part on the opening side on the one side with respect to the small diameter portion 42 at the inner peripheral surface of the frame 11. This approximately matches the size of the opening on the one side with the size of the opening on the other side. Besides, for example, the inner peripheral surface of the frame 11 may not include the tapered opening portion 41. In this case, the small diameter portion 42 may serve as the opening on the one side as it is. In this case as well, the inner peripheral surface of the frame 11 is formed into the multiple stage shape such that the part on the exhaust air side during the normal rotation has the diameter larger than the part on the air intake side during the normal rotation. Additionally, by expanding the interval between the tops 32*b* on the exhaust air side during the normal rotation at the outer peripheral edges 32*a* of the plurality of vanes 32 and the inner peripheral surface of the frame 11 by the large diameter portion 44, the improvement in the ventilation property including the silent property during the reverse rotation can be expected.

In the embodiment, the motor 20 is the outer rotor type. In the motor 20, the rotor yoke 21, which is secured to the rotation shaft 22, rotates outside the stator core 25. Besides, for example, the motor 20 may be an inner rotor type. In this case, in the motor 20, a rotor including the rotation shaft 22 rotates inside a cylindrical stator core. The rotating rotor may not be the rotor magnet 24 including a permanent magnet but may be a rotor core around which a rotor coil is wound.

The bidirectional axial fan device 1 of the comparative example illustrated in FIGS. 3 and 4 is also included in the technical scope of the present disclosure. That is, with the bidirectional axial fan device 1 according to one aspect of the present disclosure, the inner peripheral surface of the frame may not have the multiple stage shape.

That is, a bidirectional axial fan device according to an embodiment of the present disclosure may include: a motor rotatable in normal and reverse directions; a moving blade member with a plurality of vanes, the moving blade member being rotatably driven by the motor; and a casing that includes a mounting portion, a frame, and a plurality of spokes, the motor being mounted to the mounting portion, the frame forming a ventilation hole, the plurality of spokes coupling the mounting portion to the frame, a plurality of the vanes rotating in the ventilation hole. The plurality of spokes may couple the mounting portion to the frame at an exhaust air side during a normal rotation of the motor. An inner peripheral surface of the frame may have a shape, in which a part on the exhaust air side during the normal rotation has a diameter larger than a diameter of a part on an air intake side during the normal rotation, such that intervals between tops on the exhaust air side during the normal rotation at outer peripheral edges of the plurality of vanes and the inner peripheral surface of the frame are expanded.

The embodiment of the present disclosure may be a bidirectional axial fan device where a plurality of vanes of a moving blade member rotate in normal and reverse directions inside a ventilation hole of a casing.

The inner peripheral surface of the frame 11 of the venturi casing 10 can also be expressed as the inner peripheral surface of the frame 11 of the venturi casing 10 by the ventilation hole 12.

The edge 32*c* on the exhaust air side during the normal rotation of the vane 32 may curve such that the outside with respect to the center side of the rotating moving blade member 30 approaches the air intake side during the normal rotation.

In this embodiment, the inner peripheral surface of the frame 11 by the ventilation hole 12 may include the tapered opening portion 41, which expands the opening on the air intake side during the normal rotation of the frame 11, at the air intake side during the normal rotation with respect to the small diameter portion 42.

The bidirectional axial fan device according to the embodiment of the present disclosure may be the following first to fourth bidirectional axial fan devices.

The first bidirectional axial fan device includes a motor, a moving blade member, and a casing. The motor is rotatable in normal and reverse directions. The moving blade member with a plurality of vanes is rotatably driven by the motor. The casing includes a mounting portion, a frame, and a plurality of spokes. The motor is mounted to the mounting portion. The frame forms a ventilation hole. The plurality of spokes couple the mounting portion to the frame. The plurality of vanes rotate in the ventilation hole. The plurality of spokes couple the mounting portion to the frame at an exhaust air side during a normal rotation of the motor. The frame has an inner peripheral surface by the ventilation hole formed into a multiple stage shape. In the multiple stage shape, a diameter of an exhaust air side during a normal rotation is larger than a diameter of an air intake side during a normal rotation to expand intervals between tops on an exhaust air side during a normal rotation at outer peripheral edges of the plurality of vanes and the inner peripheral surface of the frame.

The second bidirectional axial fan device according to the first bidirectional axial fan device is configured as follows. The inner peripheral surface of the frame due to the ventilation hole includes a small diameter portion on an air intake side during a normal rotation, a large diameter portion on an exhaust air side during a normal rotation, and an intermediate tapered portion between the small diameter portion and a large diameter portion. The intermediate tapered portion is positioned outside the tops on an exhaust air side during a normal rotation at the outer peripheral edges of the plurality of vanes.

The third bidirectional axial fan device according to the second bidirectional axial fan device is configured as follows. The vanes each have an edge on an exhaust air side during a normal rotation. The edge curves such that an outside with respect to a center side of the rotating moving blade member approaches an air intake side during a normal rotation.

The fourth bidirectional axial fan device according to the second or the third bidirectional axial fan device is configured as follows. The inner peripheral surface of the frame by the ventilation hole includes a tapered opening portion on an air intake side during a normal rotation at the small diameter portion. The tapered opening portion expands an opening on an air intake side during a normal rotation at the frame.

In the first bidirectional axial fan device, the inner peripheral surface of the frame of the casing is formed into the multiple stage shape where the exhaust air side during the normal rotation has the diameter larger than the air intake side during the normal rotation. This expands the interval between the tops on the exhaust air side during the normal rotation at the outer peripheral edges of the plurality of vanes and the inner peripheral surface of the frame. Accordingly, provisionally, for example, compared with the case where the inner peripheral surface of the frame is flat and therefore does not have the multiple stage shape, the first bidirectional axial fan device expands the interval between these tops of the plurality of vanes and the inner peripheral surface of the frame, ensuring restraining a pressure variation of air near the top on the air intake side at the outer peripheral edge of the vane during the reverse rotation. Consequently, the air-blowing sound during the reverse rotation can be restrained. Moreover, the inner peripheral surface of the frame is formed into the multiple stage shape, increasing the diameter of the exhaust air side during the normal rotation more than the diameter of the air intake side during the normal rotation. Accordingly, provisionally, for example, the static pressure during the normal rotation does not reduce like the case where the inner peripheral surface of the frame is configured to entirely have the large diameter. The exhaust air side during the normal rotation at the inner peripheral surface of the frame, namely, the air intake side during the reverse rotation has the large diameter; therefore, although the plurality of spokes is disposed on the air intake side during the reverse rotation, the static pressure during the reverse rotation can be improved. The static pressure characteristic during the reverse rotation can be close to the static pressure characteristic during the normal rotation. Thus, the first bidirectional axial fan device ensures improving the static pressure characteristic during the reverse rotation so as to be close to the static pressure characteristic during the normal rotation. Furthermore, the first bidirectional axial fan device ensures improving the air-blowing sound during the reverse rotation so as not to cause a large influence to these static pressure characteristic during the normal rotation and static pressure characteristic during the reverse rotation.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A bidirectional axial fan device comprising:

a motor rotatable in normal and reverse directions about a rotational axis;

a moving blade member with a plurality of vanes, the moving blade member being rotatably driven by the motor; and a casing that includes a mounting portion, a frame, and a plurality of spokes, the motor being mounted to the mounting portion, the frame forming a ventilation hole, the plurality of spokes coupling the mounting portion to the frame, the plurality of vanes rotating in the ventilation hole, wherein the plurality of spokes couples the mounting portion to the frame at an exhaust air side during a normal rotation of the motor, an inner peripheral surface of the frame has a multiple stage shape, in which a part on the exhaust air side during the normal rotation has a diameter larger than a diameter of a part on an air intake side during the normal rotation, such that intervals between tops on the exhaust air side during the normal rotation at outer peripheral edges of the plurality of vanes and the inner peripheral surface of the frame are expanded, the inner peripheral surface of the frame includes a smaller diameter portion, a larger diameter portion and an intermediate tapered portion, the smaller diameter portion being disposed on the air intake side during the normal rotation, the larger diameter portion being disposed on the exhaust air side during the normal rotation, the intermediate tapered portion being disposed axially between the smaller diameter portion and the larger diameter portion, and a length of the smaller diameter portion in a direction of the rotational axis is shorter than a length of the larger diameter portion in the direction of the rotational axis.

2. The bidirectional axial fan device according to claim 1, wherein the intermediate tapered portion is positioned outside the tops on the exhaust air side during the normal rotation at the outer peripheral edges of the plurality of vanes.

3. The bidirectional axial fan device according to claim 2, wherein each of the plurality of vanes has an edge on the exhaust air side during the normal rotation, the edge curving such that an outside of the moving blade member approaches the air intake side during the normal rotation with respect to a center side of the moving blade member.

4. The bidirectional axial fan device according to claim 2, wherein the inner peripheral surface of the frame includes a tapered opening portion on the air intake side during the normal rotation with respect to the smaller diameter portion, the tapered opening portion expanding an opening on the air intake side during the normal rotation at the frame.

5. The bidirectional axial fan device according to claim 3, wherein the inner peripheral surface of the frame includes a tapered opening portion on the air intake side during the normal rotation with respect to the smaller diameter portion, the tapered opening portion expanding an opening on the air intake side during the normal rotation at the frame.

* * * * *